US009135860B2

(12) United States Patent
Choi et al.

(10) Patent No.: US 9,135,860 B2
(45) Date of Patent: Sep. 15, 2015

(54) ARRAY SUBSTRATE FOR GATE-IN-PANEL-TYPE ORGANIC LIGHT-EMITTING DIODE DISPLAY DEVICE

(71) Applicant: LG DISPLAY CO., LTD., Seoul (KR)

(72) Inventors: Ki-Min Choi, Daejeon-si (KR); In-Hyo Han, Chungcheongbuk-do (KR); Sung-Man Han, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/671,986

(22) Filed: Nov. 8, 2012

(65) Prior Publication Data

US 2013/0113688 A1 May 9, 2013

(30) Foreign Application Priority Data

Nov. 9, 2011 (KR) ..... 10-2011-0116683

(51) Int. Cl.
*G09G 3/30* (2006.01)
*G09G 3/32* (2006.01)

(52) U.S. Cl.
CPC ..... *G09G 3/3266* (2013.01); *G09G 2300/0408* (2013.01); *G09G 2300/0426* (2013.01)

(58) Field of Classification Search
CPC ..... G09G 2300/04–2300/0495; G09G 2310/0264–2310/0297
USPC ..... 345/87–104
See application file for complete search history.

(56) References Cited

U.S. PATENT DOCUMENTS

2005/0017268 A1* 1/2005 Tsukamoto et al. ..... 257/200
2009/0289886 A1* 11/2009 Sakai et al. ..... 345/98
2011/0043508 A1* 2/2011 Han et al. ..... 345/211
2012/0098799 A1* 4/2012 Kim et al. ..... 345/204
2012/0235983 A1* 9/2012 Sakamoto et al. ..... 345/212

FOREIGN PATENT DOCUMENTS

WO 2011/065045 A1 6/2011
WO WO 2011065045 A1 * 6/2011 ..... G09F 9/30

OTHER PUBLICATIONS

The First Office Action dated Dec. 3, 2014 from The State Intellectual Property Office of the People's Republic of China in a counterpart Chinese application No. 201210448114.3 (with English translation).

* cited by examiner

*Primary Examiner* — Sanghyuk Park
(74) *Attorney, Agent, or Firm* — Morgan, Lewis & Bockius LLP

(57) ABSTRACT

An array substrate for a gate-in-panel (GIP)-type organic light-emitting diode (OLED) display device is provided. A plurality of circuit blocks are formed on gate circuit units and separated into pixel lines in which respective gate lines are disposed, and a plurality of clock lines formed in each of signal input units. Each of the signal input units includes at least one group. Each of the groups includes the plurality of clock lines. Each of the circuit blocks includes one or two partial circuit blocks, which are sequentially disposed in a row in a lengthwise direction of the gate line in each of the pixel lines. Each of the partial circuit blocks is included in a signal input unit disposed most adjacent thereto, and connected to a clock line formed in one group disposed most adjacent thereto through a plurality of first connection lines.

8 Claims, 8 Drawing Sheets

ARRAY SUBSTRATE FOR GATE-IN-PANEL-TYPE ORGANIC LIGHT-EMITTING DIODE DISPLAY DEVICE

The present application claims the priority benefit of Korean Patent Application No. 10-2011-0116683 filed in the Republic of Korea on Nov. 9, 2011, which are hereby incorporated by reference in their entirety.

BACKGROUND

1. Field of the Disclosure

The present disclosure relates to an organic light-emitting diode (OLED) display device, and more particularly, to an array substrate for a gate-in-panel-type (GIP) OLED display device, which may minimize parasitic capacitance of a signal input unit.

2. Discussion of the Related Art

An organic light-emitting diode (OLED) display device, which is a flat panel display (FPD), has high luminance and a low operating voltage. Also, the OLED display device, which is an emissive display, has a high contrast ratio, may embody an ultrathin display, has a response time of about several microseconds (us) to facilitate formation of moving images, has an unlimited viewing angle, may be stably driven even at a low temperature, and be driven at a low direct-current (DC) voltage of about 5V to about 15V. Therefore, the OLED display device may facilitate the manufacture and design of a driver circuit.

Accordingly, the OLED display device having the above-described advantages has lately been employed for various information and technology (IT) apparatuses, such as televisions (TVs), monitors, and cellular phones.

Hereinafter, a basic structure of the OLED display device will be described in further detail.

FIG. 1 is a schematic cross-sectional view of a related art OLED display device.

A typical OLED display device 1 may broadly include an array substrate 10 including an array device and an OLED E, and an opposite substrate 70 disposed opposite the array substrate 10 and serving an encapsulation function. The array device may include a switching thin film transistor (TFT) (not shown) connected to gate and data lines (not shown), and a driving TFT (DTr) connected to the OLED E. The OLED E may include a first electrode 47 connected to the driving TFT DTr, an organic emission layer (EML) 55, and a second electrode 580.

To complete the OLED display device 1 having the above-described construction, a driver unit having a driver circuit configured to drive the OLED E is required.

In general, the driver unit is embodied on a printed circuit board (PCB) (not shown). In this case, the PCB is divided into a gate PCB (not shown) connected to a plurality of gate lines (not shown) formed on the array substrate 10, and a data PCB (not shown) connected to a plurality of data lines (not shown).

Meanwhile, the gate PCB and the data PCB may be respectively mounted on a gate pad portion and a data pad portion using a tape carrier package (TCP), or by interposing a flexible printed circuit (FPC) therebetween. The gate pad portion may be formed on one side surface of the array substrate 10 for the OLED display device and connected to the gate line. Also, the data pad portion is typically formed on a top side surface orthogonal to the one side surface on which the gate pad is formed, and connected to the data line.

However, when the PCB is divided into the gate PCB and the data PCB and mounted on the gate pad portion and the data pad portion as in the related art, the volume and weight of the PCB may increase.

Accordingly, to solve this problem, a gate-in-panel (GIP)-type OLED display device in which gate and data PCBs are integrated into a single PCB and mounted on only one side surface of an array substrate, has been proposed.

FIG. 2 is a plan view of an array substrate for a related art GIP-type OLED display device, and FIG. 3 is an enlarged view of region A of FIG. 2.

Referring to FIGS. 2 and 3, an array substrate 40 for a GIP-type OLED display device may broadly include a display region AA configured to display an image, a pad portion PA disposed above the display region AA, first and second gate circuit units C1 and C2 provided in a non-display region NA disposed on one side of the display region AA, and first and second signal input units S1 and S2 connected to the gate circuit units C1 and C2.

More specifically, a gate line 73, a data line 76, a TFT Tr, and a first electrode 78 may be provided on the display region AA. The gate line 73 and the data line 76 may intersect each other and define a pixel region P. The TFT Tr may be connected to each of the gate line 73 and the data line 76 and serves as a switching device. The first electrode 78 is connected to the TFT Tr.

In addition, a data pad DP and a plurality of gate pads GP may be formed on the pad portion PA disposed above the display region AA. The data pad DP may be connected to the data line 76 formed on the display region AA, and connected to an external PCB (not shown). The gate pads GP may be connected to a plurality of clock signal lines CLK1 to CLK13, and a plurality of gate signal lines $V_{GH}$, $V_{GL}$, and $V_{ST}$ formed in the first and second signal input units S1 and S2.

Furthermore, a plurality of circuit blocks CB1 and CB2 may be provided on the first and second gate circuit units C1 and C2. The circuit blocks CB1 and CB2 may be connected to one another and separated into respective pixel lines PL including a plurality of pixel regions P connected to the same gate line 73. Each of the plurality of circuit blocks CB1 and CB2 may include a combination of a plurality of switching devices, a plurality of driver devices, and a plurality of capacitors. Each of the circuit blocks CB1 and CB2, which belongs to each of the pixel lines PL, may be internally divided again into one or two partial circuit blocks PB1 and PB2. In this case, the plurality of circuit blocks CB1 and CB2 provided in the same pixel line PL may be connected to one another by the gate line 73 and a subsidiary line (not shown) provided in the pixel line PL.

The gate circuit units C1 and C2 and the signal input units S1 and S2 will be described in further detail.

In the array substrate 40 for the related art GIP-type OLED display device, the first signal input unit S1 and the first gate circuit unit C1 may sequentially alternate with the second signal input unit S2 and the second gate circuit unit C2 on the non-display region NA disposed on one side of the display region AA.

In addition, a first partial circuit block PB1 and a second partial circuit block PB2 may be provided in the first gate circuit unit C1, which belongs to each of the pixel lines PL, in a widthwise direction of the corresponding pixel line PL.

In this case, the first partial circuit block PB1 becomes an 8-phase type requiring eight different clock signals, while the second partial circuit block PB2 becomes a 5-phase type requiring five different clock signals.

Furthermore, the first signal input unit S1 may include first through eight clock lines CLK1 to CLK8 configured to input signals to the first partial circuit block PB1, ninth to thirteenth clock lines CLK9 to CLK13 configured to input signals to the second partial circuit block PB2, a gate high signal line $V_{GH}$, a gate low signal line $V_{GL}$, and a storage signal line $V_{ST}$ configured to apply a storage voltage.

Although an enlarged view is not presented, the second gate circuit unit C2 and the second signal input unit S2 may have the same configurations as the first gate circuit unit C1 and the first signal input unit C1, respectively.

However, in the above-described array substrate 40 for the related art GIP-type OLED display device, each of the first and second circuit blocks CB1 and CB2, which belongs to each of the pixel lines PL, is internally divided into the first and second partial circuit blocks PB1 and PB2 in the widthwise direction of the corresponding pixel line PL. Thus, since there are plenty of intersected and overlapped portions between the clock lines CLK1 to CLK13 and a plurality of first connection lines CL configured to connect the clock lines CLK1 to CLK13 provided in the first and second signal input units S1 and S2, the first and second signal input units S1 and S2 may have very large parasitic capacitances.

In a specific example, the 8-phase-type first partial circuit block PB1 may be connected to the first through eighth clock lines CLK1 to CLK8, while the 5-phase-type second partial circuit block PB2 may be connected to the ninth to thirteenth clock lines CLK9 to CLK13. In this case, referring to the drawings, all of a plurality of first connection lines CL connected to a plurality of elements (not shown) included in the first partial circuit block PB1 are basically configured to intersect the ninth through thirteenth clock lines CLK9 to CLK13 connected to the second partial circuit block PB2, so that relatively large parasitic capacitances may be generated.

Accordingly, since a parasitic capacitance accumulates from a first pixel line PL1 toward an n-th pixel line PLn due to the parasitic capacitances generated between the plurality of clock lines CLK1 to CLK13 and the plurality of first connection lines CL, a difference between clock signals passing through each of the clock lines CLK1 to CLK13 may occur.

As a result, the first and second gate circuit units C1 and C2 disposed relatively close to the pad portion PA on which an external PCB (not shown) is mounted, may be normally driven to output normal images to the display region AA through the pixel line PL connected to the first and second gate circuit units C1 and C2. However, the first and second gate circuit units C1 and C2 disposed relatively far away from the pad portion PA cannot properly output signals due to the accumulated parasitic capacitance, so the pixel line PL connected to the first and second gate circuit units C1 and C2 cannot output normal images to the display region AA to degrade display quality.

SUMMARY OF THE INVENTION

Accordingly, the present invention is directed to an array substrate for a gate-in-panel (GIP)-type organic light-emitting diode (OLED) display device that substantially obviates one or more of the problems due to limitations and disadvantages of the related art.

An object of the present disclosure is to provide an array substrate for an GIP-type OLED display device, which may minimize intersected portions between a plurality of clock lines provided in first and second signal input units and a plurality of connection lines connected to a plurality of elements included in first and second circuit blocks, and minimize parasitic capacitances between the plurality of clock lines and the plurality of connection lines to prevent quality degradation of images displayed on a display region.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, an array substrate for a GIP-type OLED display device includes: a substrate on which a display region configured to display images, a first non-display region disposed outside the display region and having a plurality of signal input units and a plurality of gate circuit units, which alternate with each other, and a second non-display region having a pad are defined, a gate line and a data line disposed on the display region and configured to intersect each other to define pixel regions, a plurality of circuit blocks formed on the gate circuit units and separated into pixel lines in which the respective gate lines are disposed, and a plurality of clock lines formed in each of the signal input units. Each of the signal input units includes at least one group, each group including the plurality of clock lines, each of the circuit blocks includes one or two partial circuit blocks, which are sequentially disposed in a row in a lengthwise direction of the gate line in each of the pixel lines, and each of the partial circuit blocks is included in a signal input unit disposed most adjacent thereto, and connected to a clock line formed in one group disposed most adjacent thereto through a plurality of first connection lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 4:
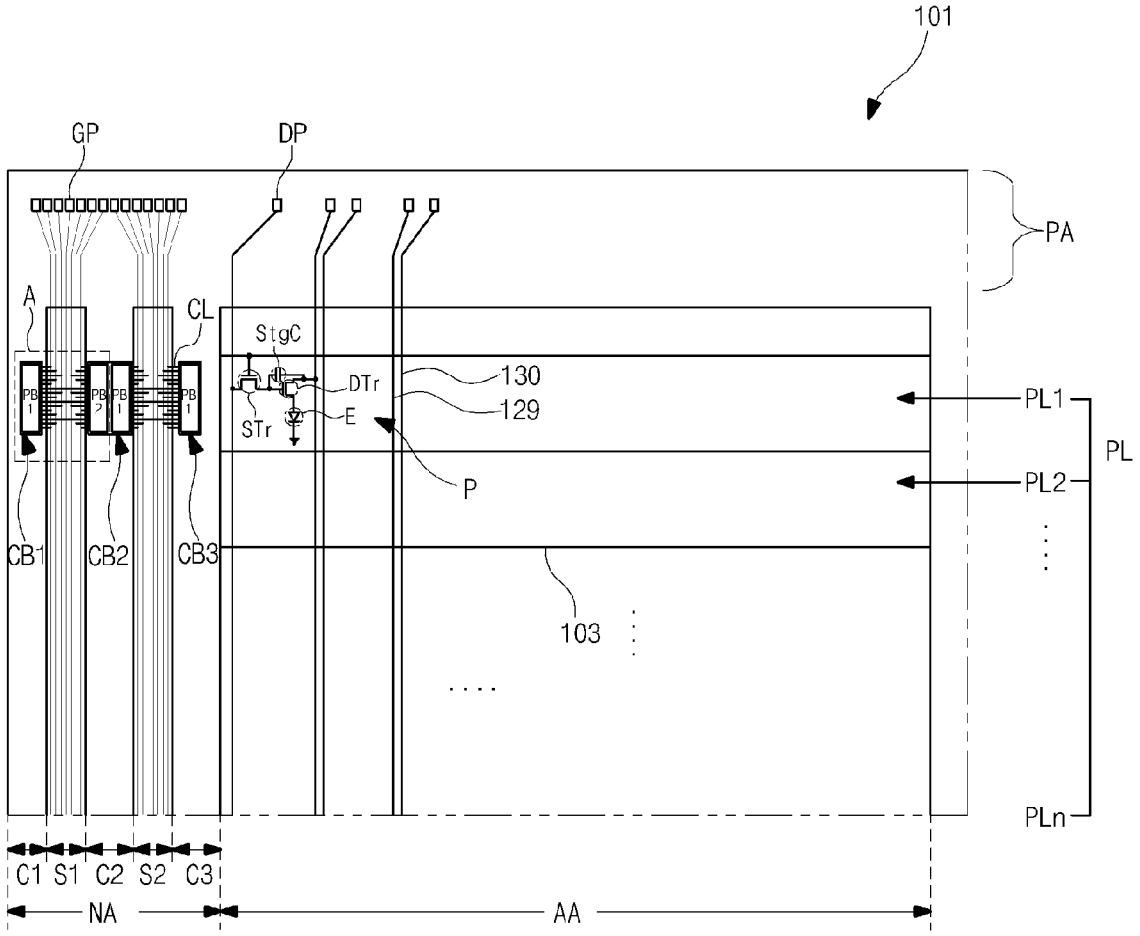
FIG. 4 is a plan view of portions of a display region and a non-display region of an array substrate for a GIP-type OLED display device according to a first embodiment of the present invention.
Figure 5:
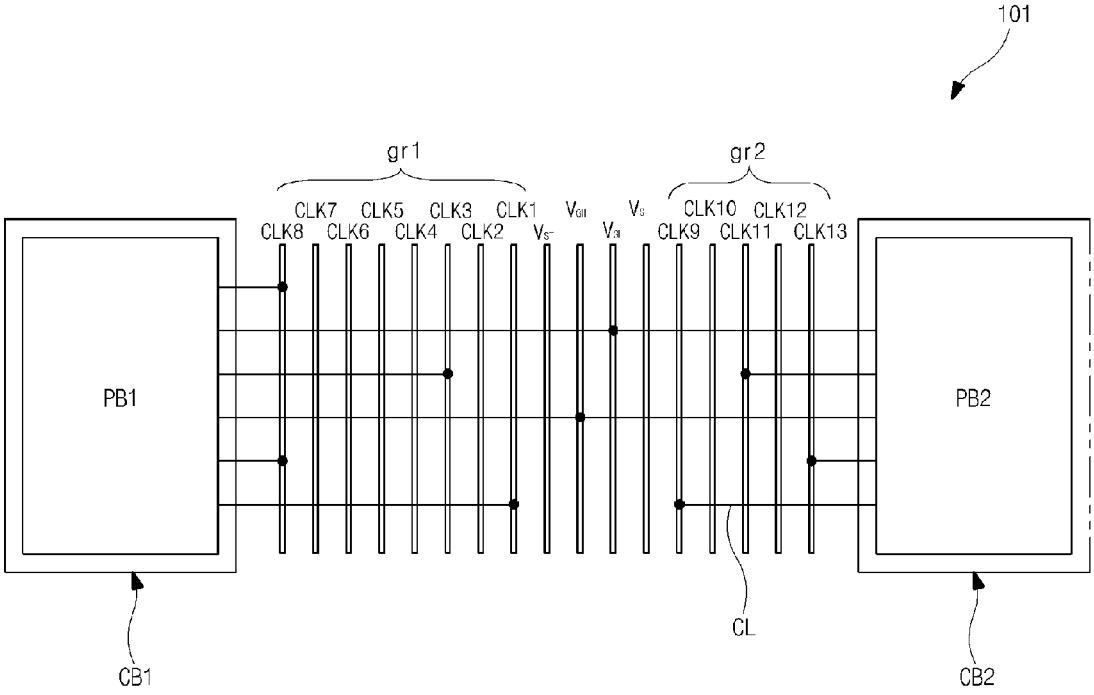
FIG. 5 is an enlarged view of region A of FIG. 4.

FIG. 4 is a plan view of portions of a display region and a non-display region of an array substrate for a gate-in-panel (GIP)-type OLED display device according to a first embodiment of the present invention, and FIG. 5 is an enlarged view of region A of FIG. 4.

Referring to FIGS. 4 and 5, an array substrate 101 for a GIP-type OLED display device according to a first embodiment of the present invention may broadly include a display region AA configured to display images, a pad portion PA disposed above the display region AA, and a non-display region NA disposed on one side of the display region AA. The non-display region NA may include a plurality of gate circuit units C1, C2, and C3 and signal input units S1 and S2, which may intersect each other.

More specifically, a plurality of gate lines 103 and a plurality of data lines 130 may be provided on the display region AA and intersect each other to define a plurality of pixel regions P. Also, a power line 129 may be disposed in the display region AA apart from the gate lines 103 or the data lines 130.

Meanwhile, a switching thin film transistor (TFT) STr may be formed in each of the pixel regions P and connected to each of the gate and data lines 103 and 130. Also, a driving TFT DTr and a storage capacitor StgC may be formed in each of the pixel regions P and connected to the switching TFT STr. At least one TFTs may be further formed in the pixel region P.

Also, a first electrode (not shown) may be provided in each of the pixel regions P and connected to the driving TFT DTr. An organic emission layer (EML) may be provided over the first electrode, and a second electrode (not shown) may be formed on the entire display region to cover the organic EML. In this case, the first electrode, the organic EML, and the second electrode may form an organic light-emitting diode (OLED) E, which may be connected to the driving TFT DTr and the power line 129.

Accordingly, when a signal is applied through the gate line 103, the switching TFT STr may be turned on. Also, a signal of the data line 130 may be transmitted to a gate electrode of the driving TFT DTr, so that the driving TFT DTr may be turned on to emit light through the OLED E. In this case, when the driving TFT DTr is turned on, the level of current flowing from the power line 129 to the OLED E may be determined so that the OLED E can embody a grayscale. When the switching TFT STr is turned off, the storage capacitor StgC may serve to maintain a constant gate voltage of the driving TFT DTr. Thus, even if the switching TFT STr is turned off, the level of the current supplied to the OLED E may be maintained constant until the next frame.

Meanwhile, a data pad DP and a gate pad GP may be provided in the pad portion PA disposed above the display region AA. The data pad DP may be connected to the data line 130 formed in the display region AA and used to connect an external printed circuit board (PCB) (not shown). The gate pad GP may serve to connect a plurality of clock lines CLK1 to CLK13 and gate signal lines $V_{GH}$, $V_{GL}$, and $V_{ST}$, which are included in the plurality of gate circuit units C1, C2, and C3, with the external PCB.

In addition, the plurality of gate circuit units C1, C2, and C3 may alternate with the plurality of signal input units S1 and S2 at one side of the display region AA. In this case, although it is exemplarily illustrated that the plurality of signal input units S1 and S2 include first and second signal input units S1 and S2, a third signal input unit (not shown) may be further disposed apart from the second signal input unit S2 and adjacent to the display region AA.

A plurality of signal lines, for example, first through thirteenth clock lines CLK1 to CLK13, gate high and low signal lines $V_{GH}$ and $V_{GL}$, and a storage signal line $V_{ST}$, may be provided in the first and second signal input units S1 and S2. Although not shown in the drawings, in addition to the gate high and low signal lines $V_{GH}$ and $V_{GL}$ and the storage signal line $V_{ST}$, power lines (not shown), for example, a VDD line (not shown) and a VSS line (not shown), may be further provided in the first and second signal input units S1 and S2. Alternatively, the power lines may not be provided in the first and second signal input units S1 and S2 but may be formed apart from the data line 130, so that power can be directly applied from an external PCB through the data pad DP to each of the pixel regions P. An end of each of the clock lines CLK1 to CLK13 and the gate signal lines $V_{GH}$, $V_{GL}$, and $V_{ST}$ may be connected to the gate pad GP. In this case, one or two storage signal lines $V_{ST}$ may be provided.

Meanwhile, first through third gate circuit units C1, C2, and C3 may be provided in the non-display region NA disposed on one side of the display region AA. The first through third gate circuit units C1, C2, and C3 may alternate with the first and second signal input units S1 and S2 and respectively disposed on one side of the first signal input unit S1, between the first and second signal input units S1 and S2, and on the other side of the second signal input unit S2. Although not shown in the drawings, when the third signal input unit is further provided in the non-display region NA disposed on one side of the display region AA, a fourth gate circuit unit (not shown) may be further provided on the other side of the third signal input unit.

In this case, circuit blocks CB1, CB2, and CB3 may be respectively provided one by one in the first through third gate circuit units C1, C2, and C3. Each of the circuit blocks CB1, CB2, and CB3 may include one or two partial circuit blocks PB1 and PB2.

In this case, an outstanding feature of the present invention is to provide the partial circuit blocks PB1 and PB2 included in each of the circuit blocks CB1, CB2, and CB3, which may correspond to the width of each of the pixel lines PL and be disposed in a row in a lengthwise direction of the gate line 103.

In an example, a first partial circuit block PB1 of an 8-phase type may be provided in the first gate circuit unit C1, while a first partial circuit block PB1 of an 8-phase type and a second partial circuit block PB2 of a 5-phase type may be provided in the second gate circuit unit C2. Also, a first partial circuit block PB1 of a 5-phase type may be provided in the third gate circuit C3 disposed on the other side of the second signal input unit S2.

Although the partial circuit blocks PB1 and PB2 of an 8-phase or 5-phase type are exemplarily illustrated, each of the partial circuit blocks PB1 and PB2 may be one of 2-phase through 10-phase types configured to receive two through 10 gate signals, and the positions of the partial circuit blocks PB1 and PB2 may be exchanged in each of the circuit blocks CB1, CB2, and CB3. Also, when the third gate circuit unit C3 further includes the third signal input unit, the third gate circuit unit C3 may further include two partial circuit blocks PB1 (and not shown).

In this case, each of the circuit blocks CB1, CB2, and CB3 included in the first through third gate circuit units C1, C2, and C3 may be connected to the plurality of signal lines (i.e., the clock lines CLK1 to CLK13, the gate high and low signal lines $V_{GH}$ and $V_{GL}$, and a storage signal line $V_{ST}$) through the plurality of first connection lines CL.

In this case, a gate circuit unit (e.g., the third gate circuit unit C3) formed most adjacent to the display region AA may be connected to the gate line 103 formed in the display region AA. Also, neighboring partial circuit blocks PB1 and PB2 disposed in the same pixel line PL and provided in one of the circuit blocks CB1, CB2, and CB3 may be electrically connected to one another.

Meanwhile, in the array substrate 101 for the GIP-type OLED display device according to the embodiment of the present invention, the partial circuit blocks PB1 and PB2 may be sequentially arranged in the same pixel line PL in the lengthwise direction of the gate line 103. Also, the first and second partial circuit blocks PB1 and PB2 included in the gate circuit unit C2 may be connected to the signal lines CLK1 to CLK13 and $V_{GH}$, $V_{GL}$, and $V_{ST}$ included in different signal input units S1 and S2 respectively disposed most adjacent to the first and second partial circuit blocks PB1 and PB2. As a result, intersections between the plurality of first connection lines CL connected to each of the partial circuit blocks PB1 and PB2 and the plurality of signal lines CLK1 to CLK13 and $V_{GH}$, $V_{GL}$, and $V_{ST}$ included in the signal input units S1 and S2, may be minimized.

Figure 3:
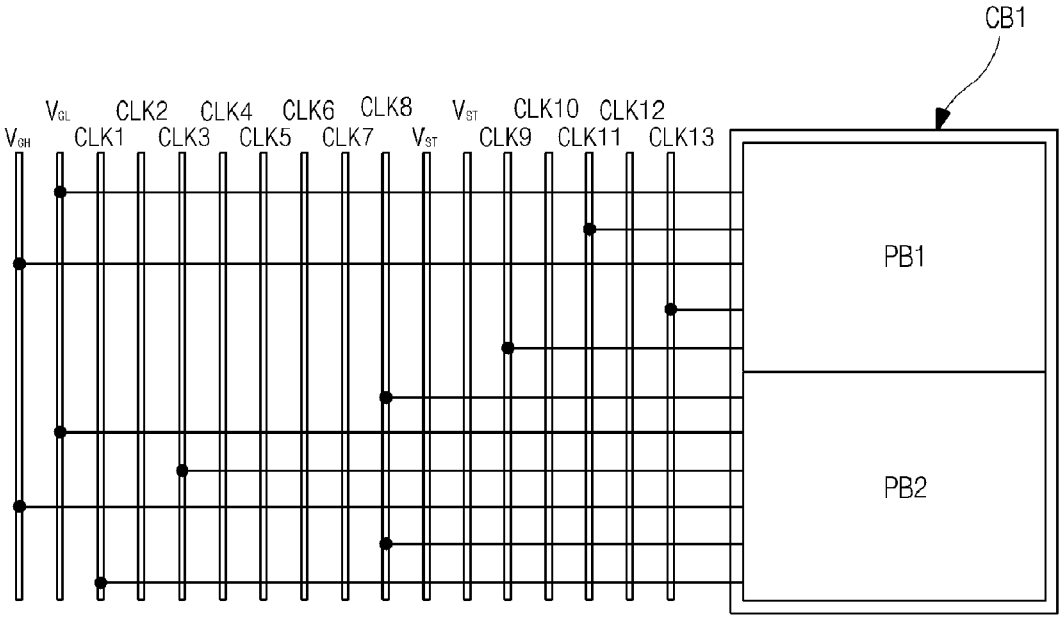
FIG. 3 Related Art
FIG. 3 is an enlarged view of region A of FIG. 2.

Therefore, since overlapped portions between the plurality of first connection lines CL and the plurality of signal lines CLK1 to CLK13 and $V_{GH}$, $V_{GL}$, and $V_{ST}$ may be reduced more than in the array substrate (refer to 40 in FIG. 3) for the related art GIP-type OLED display device, parasitic capacitances caused by the overlap between the plurality of first connection lines CL and PB2 and the plurality of signal lines CLK1 to CLK13 and $V_{GH}$, $V_{GL}$, and $V_{ST}$, which intersect each other, may be minimized.

Referring to FIG. 4, in the array substrate 101 for the GIP-type OLED display device according to the embodiment of the present invention, the 8-phase first partial circuit block PB1 included in the first gate circuit unit CB1 may be connected to the first through eighth clock lines CLK1 to CLK8 disposed adjacent to the first partial circuit block PB1, and sequentially arranged in the first signal input unit S1 disposed adjacent to the first partial circuit block PB1. Also, it can be seen that the 8-phase first partial circuit block PB1 does not intersect the ninth through thirteenth clock lines CLK9 to CLK13 connected to the second partial circuit block PB2 disposed apart from the first through eighth clock lines CLK1 to CLK8.

Furthermore, it can be seen that the second partial circuit block PB2 disposed opposite the first partial circuit block PB1 across the first signal input unit S1 may be connected to the ninth through thirteenth clock lines CLK9 to CLK13, which are disposed adjacent to the second partial circuit block PB2, and not intersect the first through eighth clock lines CLK1 to CLK8.

Accordingly, in the array substrate 101 for the GIP-type OLED display device according to the embodiment of the present invention, each of the partial circuit blocks PB1 and PB2 may be connected to the clock lines CLK1 to CLK8 or CLK9 to CLK13, which may be disposed in the signal input units S1 and S2 disposed adjacent to and on one side or the other side of the corresponding partial circuit block, and belong to a first group gr1 or a second group gr2 that may fall into a group of 8 or 5 according to the phase type of each of the partial circuit blocks PB1 and PB2. Therefore, intersected portions between the first connection lines CL and the clock lines CLK1 to CLK13 may be reduced more than in the array substrate (refer to 40 in FIG. 3) for the related art GIP-type OLED display device.

In addition, the GIP-type OLED display device having the above-described construction according to the embodiment of the present invention, parasitic capacitances caused between the clock lines CLK1 to CLK8 or CLK9 to CLK13 and the connection lines CL may be reduced so that time taken to charge and discharge data signals transmitted to a display device can be shortened. Therefore, a frame time taken to display one image may be reduced. Furthermore, when the frame time taken to display one image is adjusted to the same level as that of the related art GIP-type OLED display device, since driving frequency may be improved, a large-area display device having good display quality and high resolution may be provided.

Hereinafter, two clock line groups included in the signal input units S1 and S2 will be respectively defined as first and second groups gr1 and gr2 for brevity.

Figure 6:
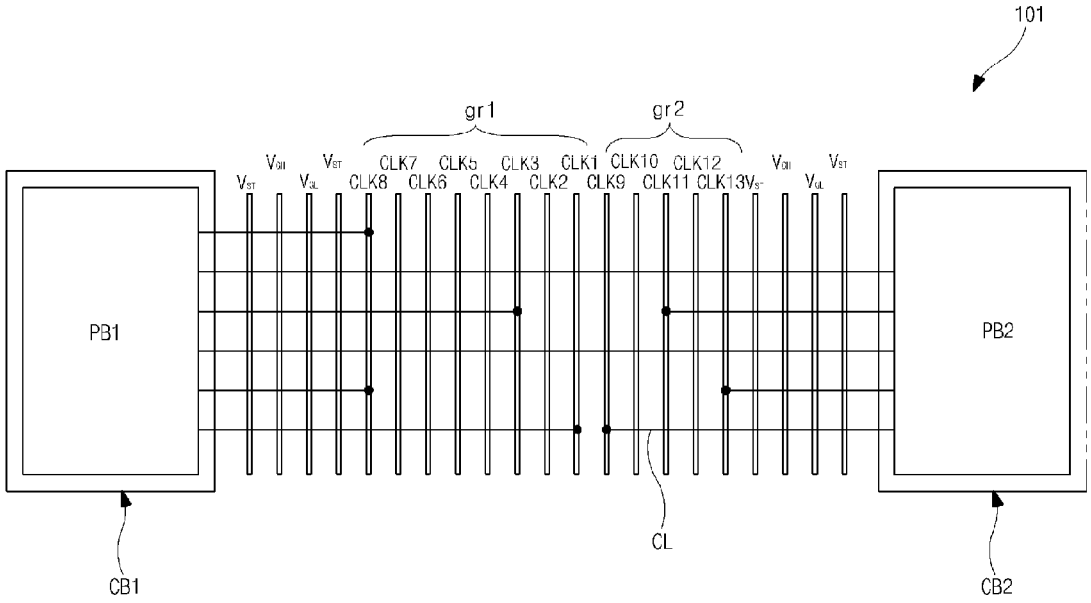
FIG. 6 is an enlarged plan view of a portion of a non-display region of an array substrate for a GIP-type OLED display device according to a first modified example of the first embodiment of the present invention.

In addition to the clock lines CLK1 to CLK13, the gate high and low signal lines $V_{GH}$ and $V_{GL}$ and the storage signal line $V_{ST}$ may be provided between the first and second groups gr1 and gr2 in each of the signal input units S1 and S2 as shown in FIG. 5. Alternatively, as shown in FIG. 6, which is an enlarged plan view of a portion of a non-display region of an array substrate for a GIP-type OLED display device according to a first modified example of the first embodiment of the present invention, the gate high and low signal lines $V_{GH}$ and $V_{GL}$ and the storage signal line $V_{ST}$ may be provided in each of the first and second groups gr1 and gr2 included in each of the signal input units S1 and S2.

Figure 7:
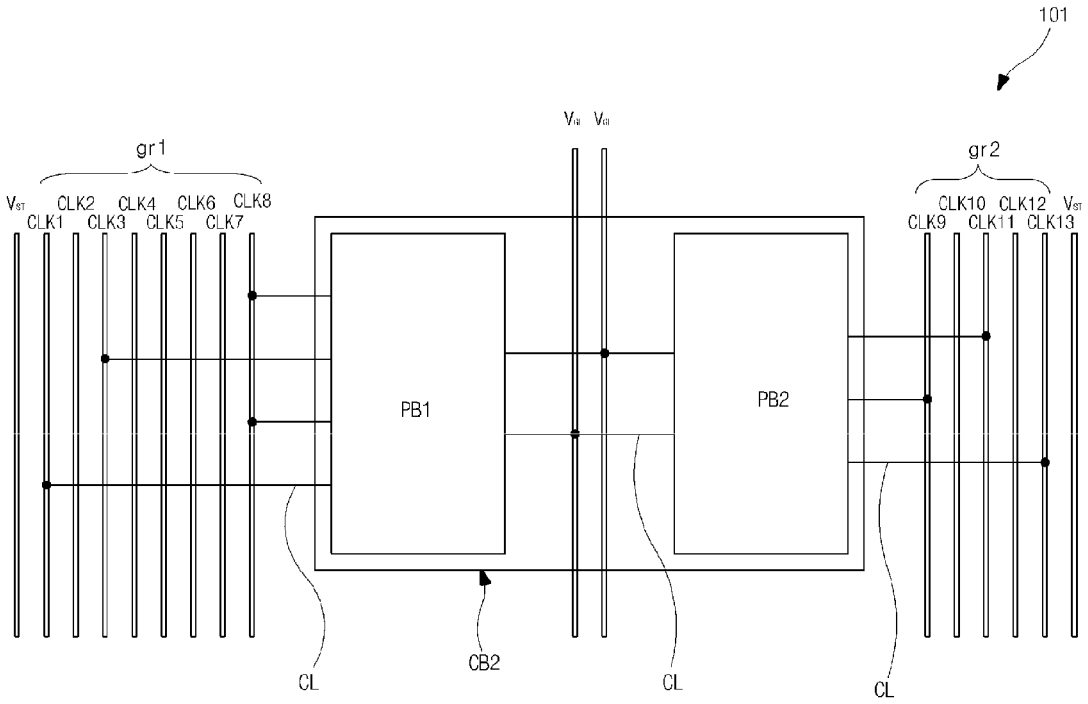
FIG. 7 is an enlarged plan view of a portion of a non-display region of an array substrate for a GIP-type OLED display device according to second modified example of the first embodiment of the present invention.

Meanwhile, as shown in FIG. 7, which is an enlarged plan view of a portion of a non-display region of an array substrate for a GIP-type OLED display device according to second modified example of the first embodiment of the present invention, the gate high and low signal lines $V_{GH}$ and $V_{GL}$ and the storage signal line $V_{ST}$ other than the clock lines CLK1 to CLK13 may not be disposed in the first and second signal input units S1 and S2 but may be disposed adjacent to each other between the partial circuit blocks PB1 and PB2 in the gate circuit unit C2 including the two partial circuit blocks PB1 and PB2. In another case, the storage signal line $V_{ST}$ may be disposed in each of the first and second groups gr1 and gr2 of each of the signal input units S1 and S2, and only the gate high and low signal lines $V_{GH}$ and $V_{GL}$ may be disposed between adjacent partial circuit blocks PB1 and PB2 provided in the same circuit block CB2.

Figure 1:
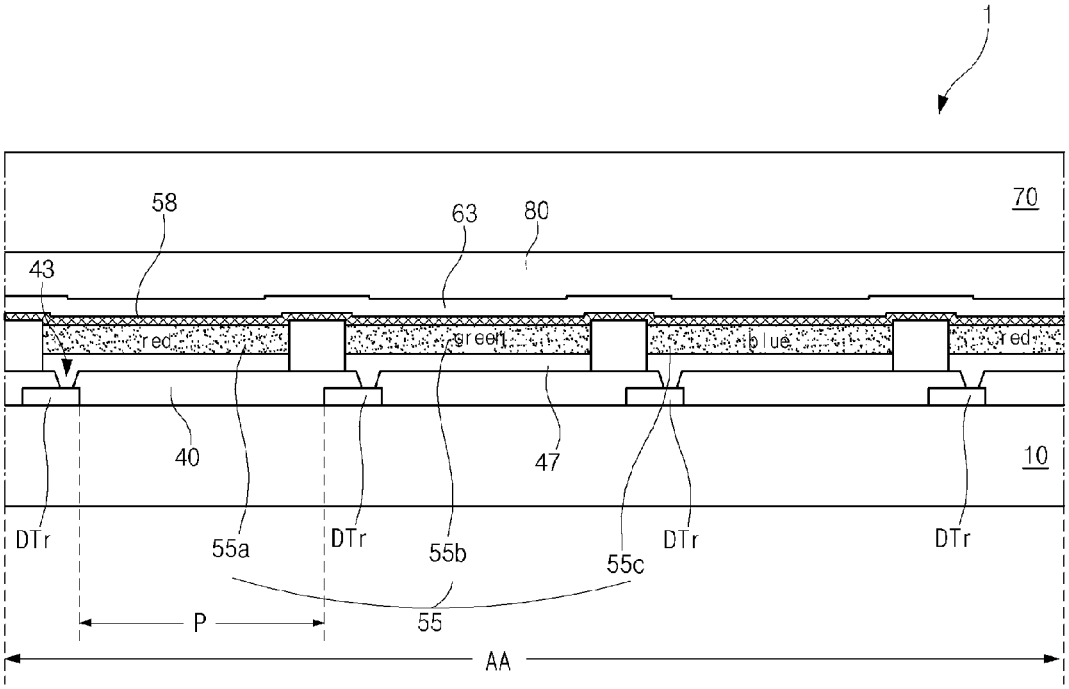
FIG. 1 Related Art
FIG. 1 is a cross-sectional view of a related art organic light-emitting diode (OLED) display device.
Figure 2:
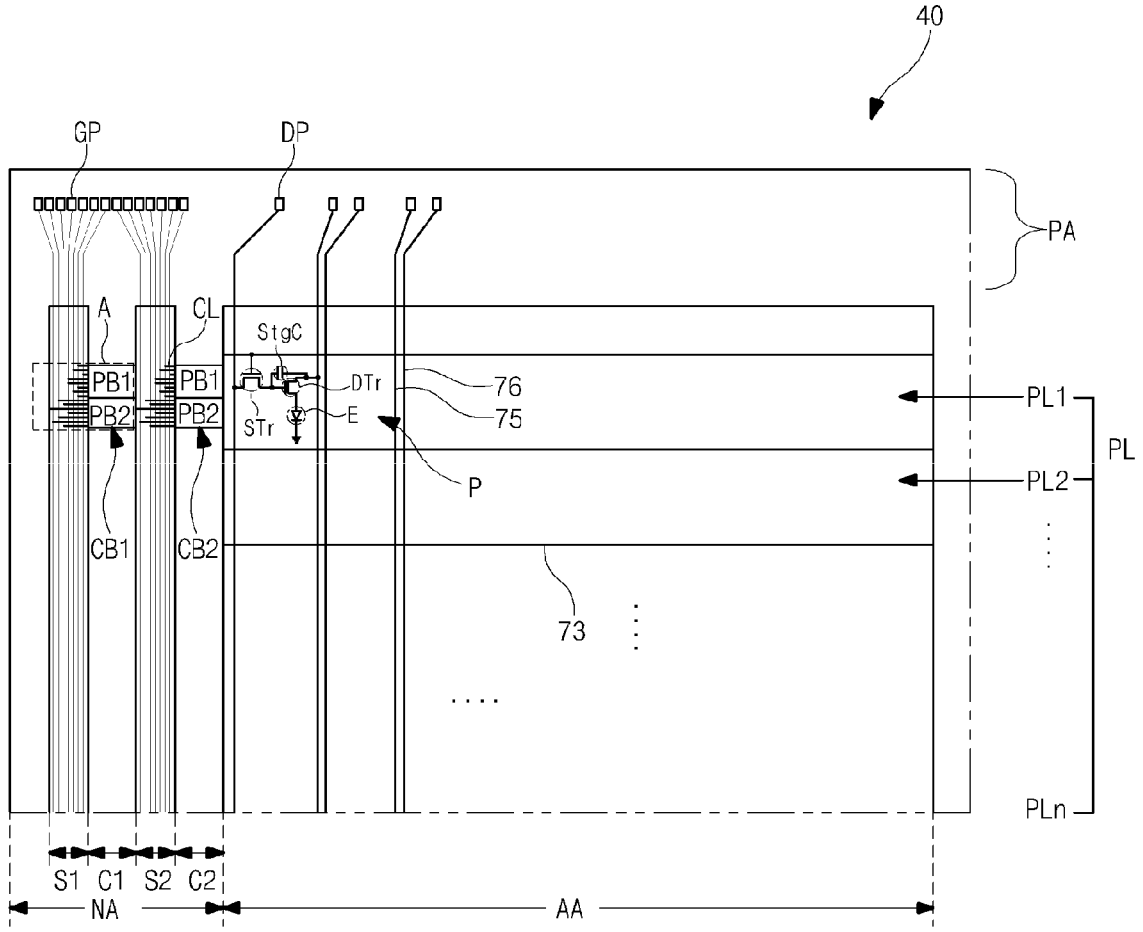
FIG. 2 Related Art
FIG. 2 is a plan view of portions of a display region and a non-display region of an array substrate for a related art gate-in-panel (GIP)-type OLED display device.

Meanwhile, in the array substrate 101 for the GIP-type OLED display device according to the first embodiment of the present invention, intersected portions between the plurality of clock lines CLK1 to CLK13 and the plurality of first connection lines CL may be reduced. Thus, it can be experimentally demonstrated that parasitic capacitance caused to all of the first and second signal input units S1 and S2 was about 38.4% less than that caused to all of the first and second signal units (refer to S1 and S2 in FIG. 2) of the array substrate for the related art GIP-type OLED display device.

That is, in the array substrate (40 in FIG. 2) for the related art GIP-type OLED display device in which the partial circuit blocks PB1 and PB2 provided in each of the pixel lines PL and also in each of the circuit blocks CB1, CB2, and CB3 of the gate circuit units C1, C2, and C3 are disposed in a vertical direction to the lengthwise direction of the gate line 103, that is, in the lengthwise direction of the data line 130, assuming that four partial circuit blocks are provided to receive four separated gate signals, and 1080 pixel lines PL are provided, the sum of parasitic capacitances caused to the first and second signal input units (refer to S1 and S2 in FIG. 2) is 535.6 pF. By comparison, in the array substrate 101 for the GIP-type OLED display device according to the first embodiment of the present invention, assuming that four partial circuit blocks PB1 and PB2 are provided to receive four separated gate signals like the array substrate 40 for the related art GIP-type OLED display device, and 1080 pixel lines are provided, the sum of parasitic capacitances caused to the first and second signal input units S1 and S2 is 329.89 pF.

Therefore, it can be seen that the parasitic capacitance of the array substrate 101 for the GIP-type OLED display device according to the first embodiment of the present invention was about 38.4% lower than that of the array substrate 40 for the related art GIP-type OLED display device.

Figure 8:
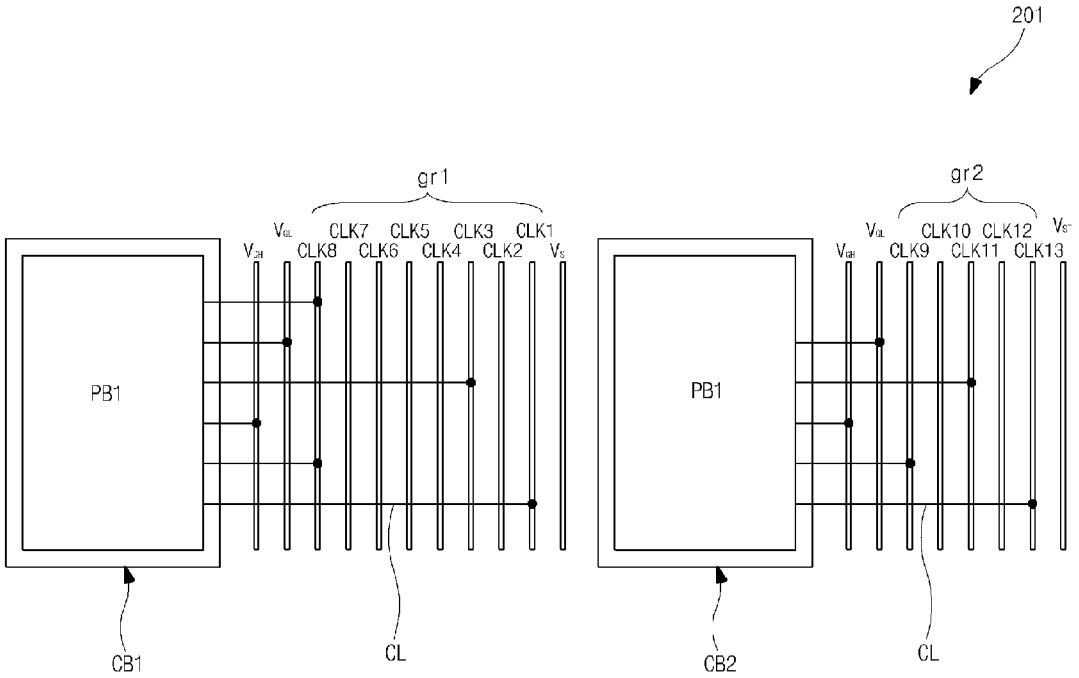
FIG. 8 is a plan view of a portion of a non-display region of an array substrate for a GIP-type OLED display device according to a second embodiment of the present invention.

FIG. 8 is a plan view of a portion of a non-display region of an array substrate for a GIP-type OLED display device according to a second embodiment of the present invention. Here, differences between the constructions according to the first and second embodiments will be chiefly described.

Referring to FIG. 8, in an array substrate 201 for a GIP-type OLED display device according to the second embodiment of the present invention, signal input units S1 (and not shown) and gate circuit units C1, C2 (and not shown) may alternate with each other and be provided in the same number. Each of the gate circuit units C1, C2 (and not shown) may include one circuit block CB1, CB2 (or not shown) in the same pixel line PL. In this case, each of the circuit blocks CB1, CB2 (or not shown) may include only one partial circuit block PB1 provided as a 5-phase or 8-phase type.

Accordingly, each of the signal input units S1, S2 (and not shown) may be connected only to the circuit block CB1, CB2 (or not shown) disposed on one side of the corresponding signal input unit. Also, according to the phase type of the partial circuit block PB1 provided in the circuit block CB1, each of the signal input units S1, S2 (and not shown) may include first through fifth clock lines CLK1 to CLK5 or first through eighth clock lines CLK1 to CLK8, gate low and high signal lines $V_{GH}$ and $V_{GL}$, and one storage signal line $V_{ST}$.

Since the remaining elements are the same as those of the array substrate 101 for the GIP-type OLED display device according to the first embodiment, a description thereof is omitted.

Similarly, in the array substrate 201 for the GIP-type OLED display device according to the second embodiment of the present invention, the partial circuit blocks CB1, CB2 (and not shown) may be arranged in a row in a lengthwise direction of the gate line 203 in the same pixel line PL, and a first connection line CL1 may be connected to the clock lines CLK1 to CLK5 or CLK1 to CLK8 of the signal input unit S1, S2 (or not shown) disposed most adjacent to each of the partial circuit blocks PB1. Thus, since intersections between a plurality of first connection lines CL and the clock lines CLK1 to CLK5 or CLK1 to CLK8 may be reduced more than in the array substrate (refer to 40 in FIG. 2) for the related art GIP-type OLED display device, parasitic capacitances caused by overlap between the plurality of first connection lines CL and the clock lines CLK1 to CLK5 or CLK1 to CLK8 may be minimized.

In a GIP-type OLED display device according to the present invention, first through sixth partial blocks included in each of circuit blocks separated into respective pixel lines in first through third gate circuit units, can be disposed in a lengthwise direction of the pixel lines. Thus, intersections between the plurality of clock lines formed in the first through third gate circuit units and a plurality of connection lines connected to the first and second circuit blocks can be minimized to minimize parasitic capacitances therebetween.

Furthermore, since gate signals can be smoothly supplied from a first pixel line to an n-th pixel line due to a reduction in parasitic capacitances between the clock lines and the connection lines, a signal delay can be reduced, thereby improving the quality of images displayed on a display region.

In addition, since the parasitic capacitances between the clock lines and the connection lines are reduced, time taken to charge and discharge data signals transmitted to the display region can be shortened so that a frame time taken to display one image can be reduced. Also, when the frame time taken to display one image is adjusted to the same level as that of the related art GIP-type OLED display device, since driving frequency can be improved, a large-area display device having good display quality and high resolution can be provided.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. An array substrate for a gate-in-panel (GIP)-type organic light-emitting diode (OLED) display device, comprising:

a substrate on which a display region configured to display images, a first non-display region disposed outside the display region and having a plurality of signal input units and a plurality of gate circuit units, which alternate with each other, and a second non-display region having a pad are defined;

a gate line and a data line disposed on the display region and configured to intersect each other to define a pixel region;

a plurality of circuit blocks formed on the gate circuit units and separated into pixel lines in which the respective gate lines are disposed; and a plurality of clock lines formed in each of the signal input units, wherein each of the signal input units includes at least one group, each group including the plurality of clock lines, each of the circuit blocks includes one or two partial circuit blocks, which are sequentially disposed in a row in a lengthwise direction of the gate line in each of the pixel lines, and each of the partial circuit blocks is included in a signal input unit disposed most adjacent thereto, and connected to a clock line formed in one group disposed most adjacent thereto through a plurality of first connection lines, wherein one of the signal input units is connected to partial circuit blocks disposed on opposite sides of the one of the signal input units, the one of the signal input units includes at least one of a gate high signal line, a gate low signal line, and a storage line, and the at least one of the gate high signal line, the gate low signal line, and the storage line included in the one of the signal input units connects to each of the partial circuit blocks disposed on opposite sides of the one of the signal input units.

2. The array substrate of claim 1, wherein each of the circuit blocks formed in the same pixel line includes one partial circuit block, and each of the signal input units includes one group.

3. The array substrate of claim 1, wherein each of the signal input units includes first and second groups, and wherein, among the circuit blocks formed in the same pixel line, the circuit block of which the signal input units are disposed on both sides includes two partial circuit blocks disposed adjacent to each other, and the circuit block of which the signal input unit is disposed on one side or the other side includes one partial circuit block.

4. The array substrate of claim 3, wherein, among the gate circuit units, the gate circuit unit including two partial circuit blocks includes a gate high signal line and a gate low signal line formed between the partial circuit blocks.

5. The array substrate of claim 1, wherein each of the signal input units includes a gate high signal line, a gate low signal line, and a storage line disposed adjacent to the plurality of clock lines.

6. The array substrate of claim 5, wherein each of the signal input units includes two groups, and the gate high signal line, the gate low signal line, and the storage line are formed between adjacent groups.

7. The array substrate of claim 1, further comprising:

a switching thin film transistor (TFT) formed in each of the pixel regions and connected to the gate and data lines;

a power line formed apart from the gate line or the data line;

a driving TFT formed in each of the pixel regions and connected to the switching TFT and the power line; and an OLED connected to the driving TFT and the power line, the OLED including a first electrode, an organic emission layer (EML), and a second electrode.

8. The array substrate of claim 1, wherein the circuit blocks disposed in the same pixel line are connected to the gate line provided in the corresponding pixel line.

* * * * *